US008801461B2

(12) United States Patent
Kim et al.

(10) Patent No.: US 8,801,461 B2
(45) Date of Patent: Aug. 12, 2014

(54) STEPPED TERMINATION BLOCK

(75) Inventors: Min Chul Kim, Santa Clara, CA (US); Paul Yuan, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 13/370,279

(22) Filed: Feb. 9, 2012

(65) Prior Publication Data

US 2013/0210272 A1 Aug. 15, 2013

(51) Int. Cl.
*H01R 9/05* (2006.01)

(52) U.S. Cl.
USPC ..... 439/581

(58) Field of Classification Search
USPC ..... 439/581, 628, 607.51, 607.41; 174/388, 174/113 R, 107
See application file for complete search history.

(56) References Cited

U.S. PATENT DOCUMENTS

| | | | | |
|---|---|---|---|---|
| 6,498,300 | B2 * | 12/2002 | Flick | 174/110 R |
| 7,267,579 | B1 * | 9/2007 | Wu | 439/607.57 |
| 7,530,847 | B2 * | 5/2009 | Siems | 439/607.41 |
| 7,692,099 | B2 * | 4/2010 | Burke | 174/113 R |
| 7,955,132 | B2 * | 6/2011 | Luo | 439/607.41 |
| 7,955,137 | B2 * | 6/2011 | Ko et al. | 439/660 |
| 8,002,572 | B2 * | 8/2011 | Lu et al. | 439/405 |
| 8,333,617 | B2 * | 12/2012 | Fjelstad | 439/660 |
| 8,342,857 | B2 * | 1/2013 | Palli et al. | 439/38 |
| 2004/0147166 | A1 * | 7/2004 | Lai | 439/610 |
| 2007/0141907 | A1 * | 6/2007 | Kuo et al. | 439/607 |
| 2009/0203261 | A1 * | 8/2009 | Ikegami et al. | 439/628 |
| 2010/0116541 | A1 * | 5/2010 | Eshima | 174/388 |
| 2010/0132976 | A1 * | 6/2010 | Tognali et al. | 174/113 R |
| 2010/0139943 | A1 * | 6/2010 | Abe et al. | 174/107 |

* cited by examiner

*Primary Examiner* — Tulsidas C Patel
(74) *Attorney, Agent, or Firm* — Kilpatrick Townsend & Stockton, LLP

(57) ABSTRACT

Structures and methods that simplify the assembly of connector inserts. One example may provide a connector insert having a termination block that is arranged to receive an end of a cable. The termination block may provide a first number of conductors in a first row and a second number of conductors in a second row. The termination block may be stepped such that the first number of conductors emerge from the termination block at a different position along their lengths than the second number of conductors. The first number of conductors may then attach to a first side of a printed circuit board or other connector portion, while the second number of conductors may then attach to a second side of the printed circuit board or other connector portion.

23 Claims, 12 Drawing Sheets

STEPPED TERMINATION BLOCK

BACKGROUND

The number and types of electronic devices available to consumers have increased tremendously the past few years, and this increase shows no signs of abating. Devices such as portable computing devices, tablet, desktop, and all-in-one computers, cell, smart, and media phones, storage devices, portable media players, navigation systems, monitors and other devices have become ubiquitous.

These devices often receive and provide power and data using various cable assemblies. These cable assemblies may include connector inserts, or plugs, on one or more ends of a cable. The connector inserts may plug into connector receptacles on electronic devices, thereby forming one or more conductive paths for signals and power.

These cables typically have one or more conductors that convey power and signals between devices. These conductors may connect to printed circuit boards or other structures in the connector inserts. The printed circuit boards may support components for amplifying or retiming data, for providing signal terminations, or for other purposes. Various conductors and these components may electrically connect to contacts in the inserts. When an insert is inserted in a receptacle on an electronic device, contacts in the insert electrically connect to contacts in the receptacle, which in turn may connect to circuits or components in the electrical device.

The devices that these cables connect to have become smaller over time as customer preferences for sleeker devices have been met. This, in turn, has necessitated the development of ever-smaller connector receptacles, and correspondingly smaller connector inserts. But it is more complicated to assemble these smaller connector inserts. The conductors need to be trimmed or otherwise prepared so that they can be soldered to the printed circuit board or other structure. Once prepared, the conductors need to be soldered. This can be very difficult to accomplish given these smaller form factors.

Thus, what is needed are structures and methods that simplify the assembly of connector inserts.

SUMMARY

Accordingly, embodiments of the present invention may provide structures and methods that simplify the assembly of connector inserts. One illustrative embodiment of the present invention may provide a connector insert having a termination block that is arranged to receive an end of a cable. The termination block may provide a first number of conductors in a first row and a second number of conductors in a second row. The termination block may be stepped such that the first number of conductors emerges from the termination block at a different position along their lengths than the second number of conductors. That is, the termination block may be formed around the first number of conductors for a shorter length than the termination block is around the second number of conductors. The first number of conductors may then attach to a first side of a printed circuit board or other connector portion, while the second number of conductors may then attach to a second side of the printed circuit board or other connector portion.

Another illustrative embodiment of the present invention provides a cable having a first number of conductors and a second number of conductors. The first number of conductors may be power conductors, while the second row of conductor may be signal conductors. The signal conductors may be coaxial cables, twisted pairs, shielded-twisted pairs, or other conductors. In a specific embodiment of the present invention, the cable may include a core having three conductors and three fibers, such as cotton, aramid, or other types of fibers, the core surrounded by eleven coaxial cables, though in other embodiments of the present invention, other numbers of conductors, fibers, and coaxial cables may be included. The cable, including the power conductors and signal conductors, may be received by a termination block. The power conductors may emerge from the termination block in a first row, while the signal conductors may emerge from the termination block in a second row. The termination block may be stepped such that the power conductors emerge from the termination block at a different point along their length than the signal conductors. The power conductors may then attach to a first side of a printed circuit board or other connector portion, while the signal conductors may then attach to a second side of the printed circuit board or other connector portion.

Another illustrative embodiment of the present invention provides a connector insert having a termination block that may provide a simplified method of assembly. This embodiment may provide a termination block for receiving a cable having a first number of conductors and a second number of conductors. The first number of conductors may emerge from the termination block in a first row while the second number of conductors may emerge from the termination block in a second row. The second row of conductors may be trimmed, for example by using one or more lasers. This trimming, or stripping, may include removal of insulating layers, shielding layers, or other layers. To assist in this stripping, the first row of conductors may be bent or folded out of the way of the second conductors. The first row of conductors may then be trimmed or stripped. The first row of conductors may then be attached to a first side of a printed circuit board and the second row of conductors may then be attached to a second side of the printed circuit board.

Another illustrative embodiment of the present invention may provide a connector insert having a crimping piece to crimp around at least a portion of a braiding of a cable. The crimping piece may be in contact with a printed circuit board in the connector insert, for example at one or more ground contacts. The crimping piece may be in further contact with a shield or housing of the connector insert. This arrangement may facilitate heat removal from circuitry in the connector insert. Specifically, heat from circuitry on the printed circuit board flows into the crimping piece, whereby it may disperse via the shield or housing as well as through the cable braiding.

Another illustrative embodiment of the present invention may provide a connector insert having a termination block that is formed in two or more portions. In one specific embodiment of the present invention, a first row of conductors may emerge from a first termination block portion to be partially housed in a second termination block portion, while a second row of conductors may be partially housed in the first termination block person and not housed in the second termination block portion.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
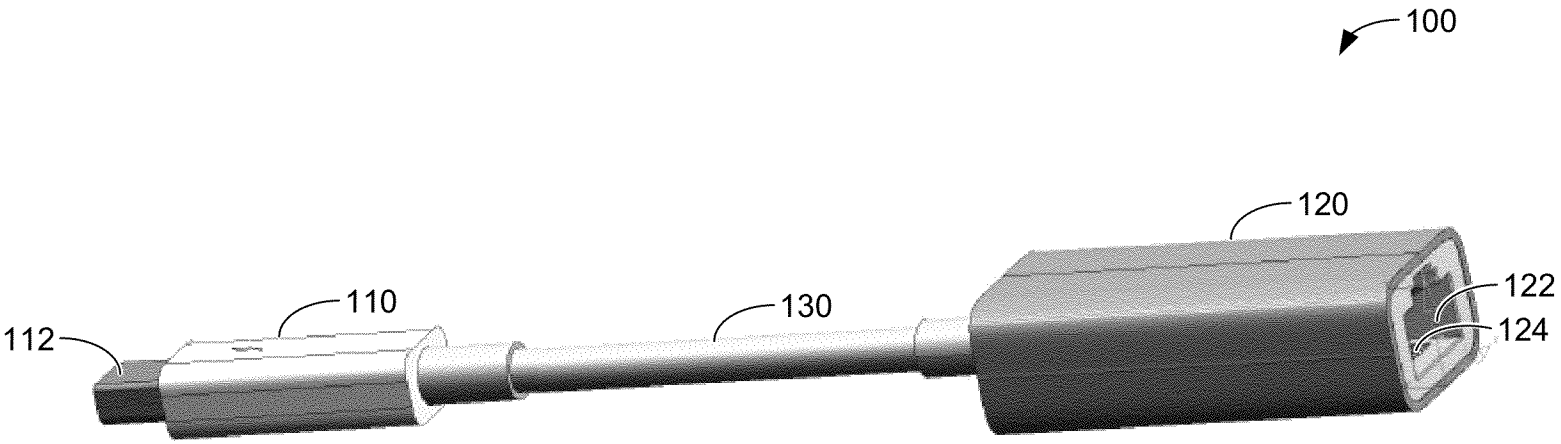
FIG. 1 illustrates a cable assembly that may be improved by the incorporation of embodiments of the present invention.

FIG. 1 illustrates a cable assembly that may be improved by the incorporation of embodiments of the present invention. This figure, as with the other included figures, is shown for illustrative purposes and does not limit either the possible embodiments of the present invention or the claims.

In this example, cable assembly 100 is shown as a cable adapter. While embodiments of the present invention may be used to improve cable adapters, other types of cables may be improved by the incorporation of embodiments of the present invention. Cable assembly 100 includes connector insert 110 coupled to connector receptacle 120 via cable 130. Cable insert 110 may include shield portion 112. Shield portion 112 may be arranged to insert into a corresponding connector receptacle (not shown). One or more contacts (not shown) located in shield portion 112 may form electrical connections with contacts in the corresponding connector receptacle. Connector receptacle 120 may include opening 122 in which contacts 124 are located. Opening 122 may accept a corresponding connector insert. Contacts 124 may make electrical connections with contacts in the corresponding connector insert. Cable 130 may include one or more conductors for conveying signals and power between connector insert 110 and connector receptacle 120. An example of such a cable is shown in the following figure.

Figure 2:
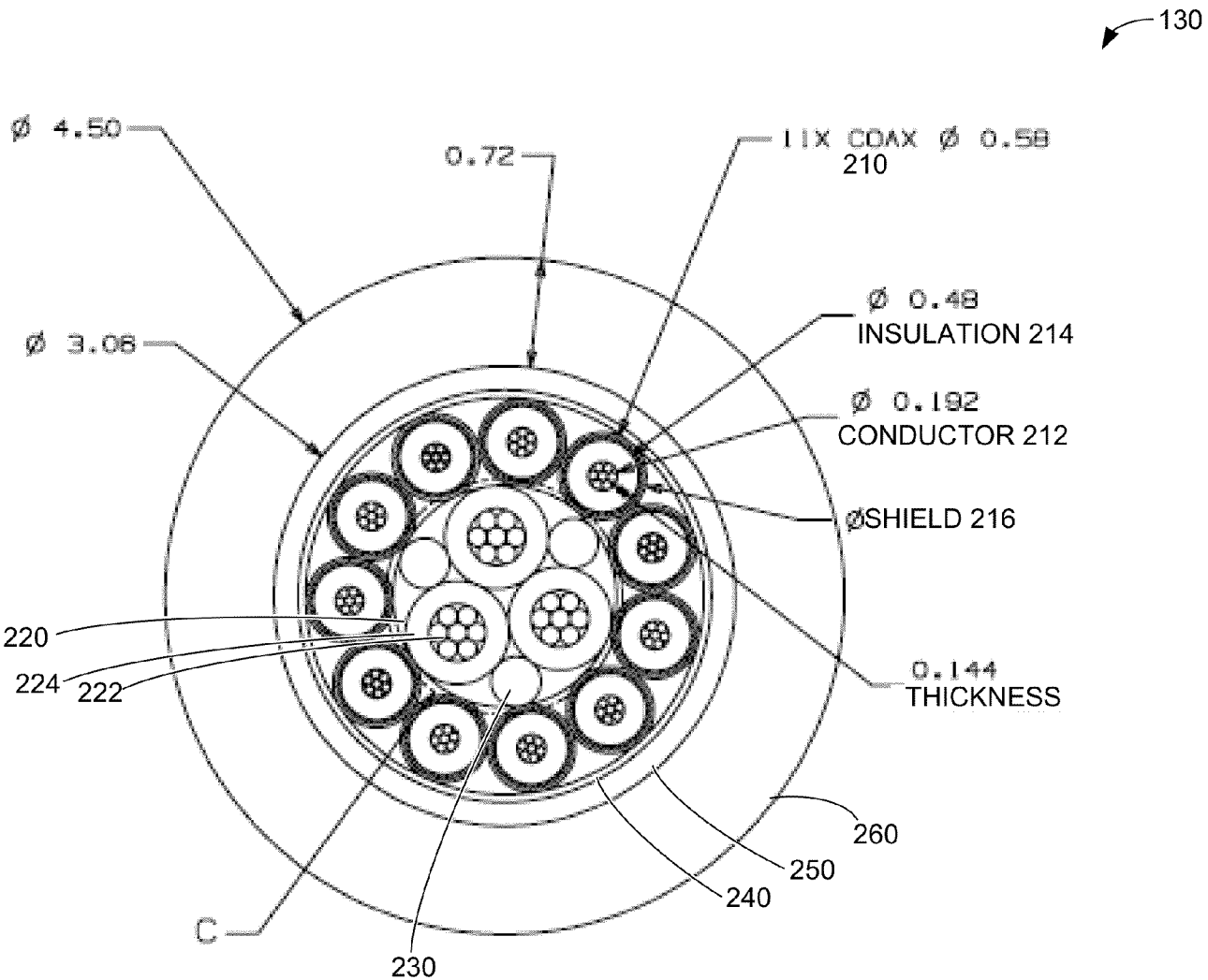
FIG. 2 illustrates a cross-section view of a cable according to an embodiment of the present invention.

FIG. 2 illustrates a cross-section view of a cable according to an embodiment of the present invention. In this example, cable 130 may include a first number of conductors 220 in a core surrounded by a second number of conductors 210. Specifically, cable 130 may include a number of conductors 220 in a core, where conductors 220 may be formed of a number of wires 222 surrounded by in insulating layer 224. Conductors 220 may be used to convey power or signals.

The core of cable 130 may further include fibers 230. Fibers 230 may be included for mechanical stability and cable strength. Fibers 230 may be cotton fibers, aramid fibers, or other types of fibers. In other embodiments of the present invention, fibers 230 may be replaced by wires or fiber-optic lines.

The central core formed by the power conductors 220 and fibers 230 may be surrounded by Mylar tape or other layer. This central core may further be surrounded by a number of second conductors 210. Second conductors 210 may be used to convey power or signals. In a specific embodiment of the present invention, these second conductors may be coaxial cables 210. Coaxial cables 210 may be formed of conductors 212, which may be surrounded by insulation 214, which in turn may be surrounded by shield 216. Mylar tape layer 240 may be used to secure coaxial cables 210 to each other and to the center portion. Shield layer 250 may provide shielding for cable 130. Shield layer 250 may be formed of wire braiding, one or more rotating spirals, or other shield layer. Insulating jacket 260 may be used to provide mechanical support for cable 130.

Again, this embodiment of the present invention, a number of coaxial cables may be used to convey signals. In other embodiments of the present invention, other types of conductors may be used. For example, shielded wires may be used. In other embodiments of the present invention, twisted pairs, such as shielded-twisted pairs, may be used. An example of a coaxial cable that may be used as a conductor 210 is shown in the following figure.

Figure 3:
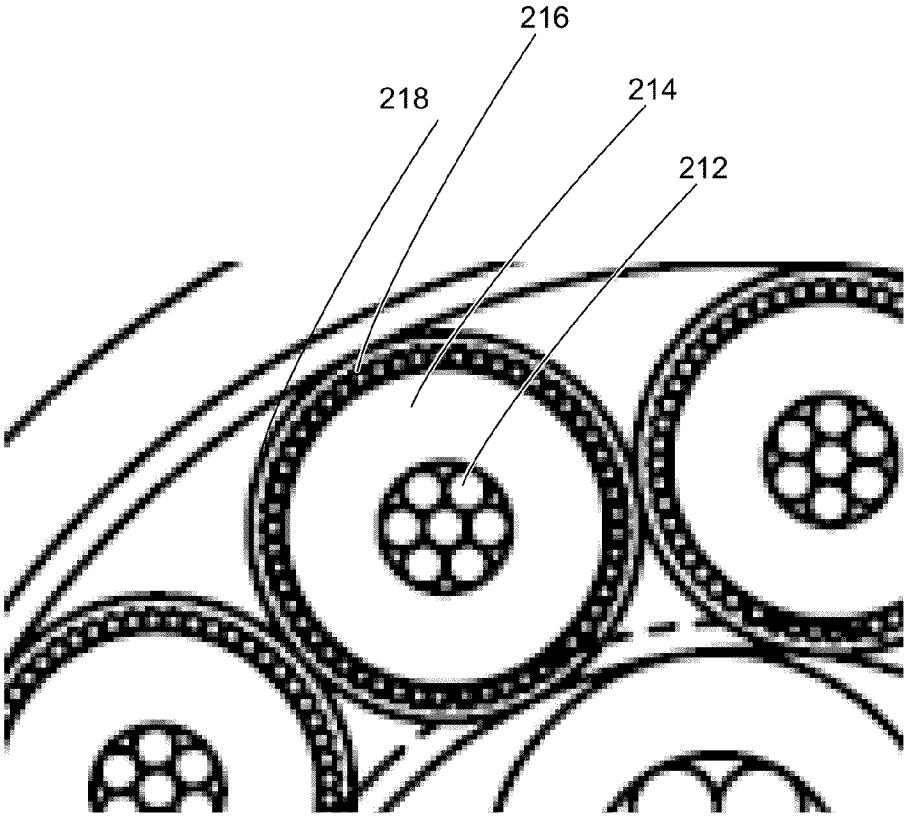
FIG. 3 illustrates a detailed portion of a cross-section of a coaxial cable according to an embodiment of the present invention.

FIG. 3 illustrates a detailed portion of a cross-section of a coaxial cable according to an embodiment of the present invention. In this example, a coaxial cable including conductor 212, surrounded by insulating layer 214, which is surrounded by shield layer 216, is shown. Shield layer may be surrounded by a second insulating layer 218. Conductor 212 may be formed of a number of wires. For example, conductor 212 may be formed of a number of wires arranged as a Litz wire. In various embodiments of the present invention, coaxial-shield layer 216 may be formed of a braiding, of one or more rotating spirals, or other shielding structure.

In the above examples, a shield layer may be included around one or more conductors 210 and 220, or around cable 130. In these examples, the shield may be braided. In these and other embodiments of the present invention, the shield may be formed of layers of wire arranged in counter-rotating spirals. Specifically, the shield may be formed of layers of wires, where the wires in each layer are roughly in parallel with each other. These wires may wrap in a rotating manner along the length of a cable at an angle. In a specific embodiment of the present invention, the angle is approximately seventeen degrees, though in other embodiments of the present invention, other angles may be used. Shields formed in this manner may include one, two, or more than two layers of wires. For example, a shield may include two layers of wires wrapped in counter-rotating spirals. An example is shown in the following figure.

Figure 4:
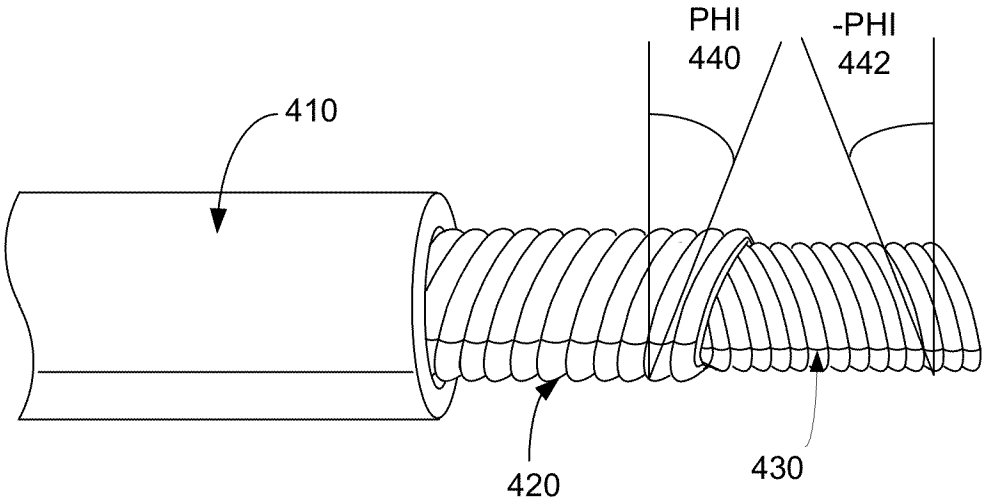
FIG. 4 illustrates a side view of a portion of a cable according to an embodiment of the present invention.

FIG. 4 illustrates a side view of a portion of a cable according to an embodiment of the present invention. This figure illustrates a cable or cable portion surrounded by jacket 410. Jacket 410 has been cut away to reveal a first counter-rotating spiral 420 and a second counter-rotating spiral 430. The first of these spirals may have an angle approximately equal to phi 440. In a specific embodiment of the present invention, phi may be equal to 17 degrees. In other embodiments of the present invention, other angles may be used. The second of these may have approximately the same relative angle, shown here as negative phi 442 to indicate a different absolute direction.

In this way, during manufacturing, the wires in the counter-rotating spirals 420 and 430 may be easily peeled away, straightened, and soldered or otherwise electrically connected to locations in a connector insert.

Utilizing counter-rotating spirals 420 and 430 may also improve the flexibility of the cable. For example, when the cable is twisted in a first direction, counter-rotating spiral 420 may tighten while counter-rotating spiral 430 may loosen. The tightening of counter-rotating spiral 420 may protect the internal conductors. Similarly, when the cable is twisted in a second direction, counter-rotating spiral 430 may tighten while counter-rotating spiral 420 may loosen. The tightening of counter-rotating spirals 430 may again protect the internal conductors.

Again, one or more different types of fibers may be employed by embodiments of the present invention. These fibers may be interspersed singly or in groups in one or more of the counter-rotating spirals 420 and 430. These fibers may be included for various reasons, for example, to improve cable strength.

In a specific embodiment of the present invention, aramid fibers may be included for additional strength. Again, aramid fibers may interfere with soldering of the counter-rotating spirals 420 and 430 to locations such as a shield of, or pads in, a connector insert. Accordingly, in various embodiments of the present invention, these fibers may be pulled away from the wires in the counter-rotating spirals 420 and 430 by static electricity, air movement, or other methods.

In various embodiments of the present invention, one rotating spiral, or two or more rotating spirals, which may be counter-rotating spirals, may be included. These spirals may be used to shield conductors 210, cable 130, or other conductors or cables.

Again, coaxial cables 210 may surround a cable core including a number of conductors and fibers. An example of such a core is shown in the following figure.

Figure 5:
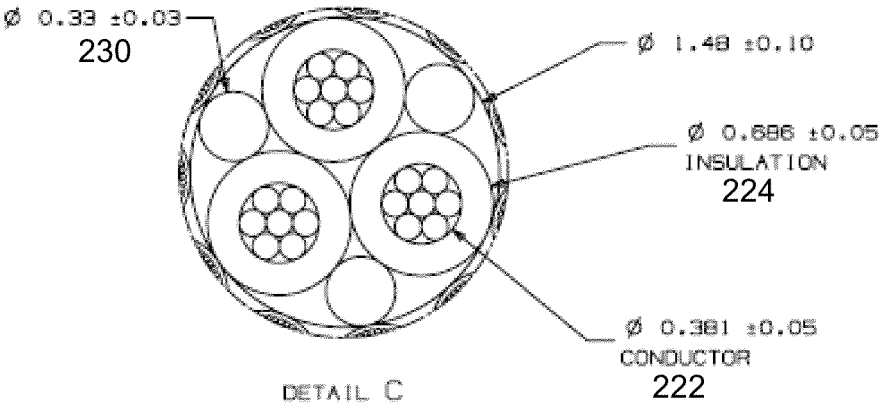
FIG. 5 illustrates a cross-section view of a core of a cable according to an embodiment of the present invention.

FIG. 5 illustrates a cross-section view of a core of a cable according to an embodiment of the present invention. This cross-section includes a number of conductors 222, each surrounded by insulating layers 224. As before, conductors 222 may be formed of one or more wires, which may be optionally arranged as a Litz wire. A number of fibers 230 are also included. These fibers may be cotton, aramid fibers, other conductors, fiber-optic lines, or other appropriate structures.

Again, the conductors in cable 130 may connect to contacts or circuitry in a connector insert or connector receptacle, such as connector insert 110 or connector receptacle 120 in FIG. 1. Specifically, conductors 210 and 220 may contact a printed circuit board, contacts, or other structure in connector insert 110 and connector receptacle 120. To simplify this construction, embodiments of the present invention may employ termination blocks. These termination blocks may be formed around a portion of an end of a cable such that these conductors are received by the termination block and provided at appropriate positions to be connected to contacts on a printed circuit board. An example is shown in the following figure.

Figure 6:
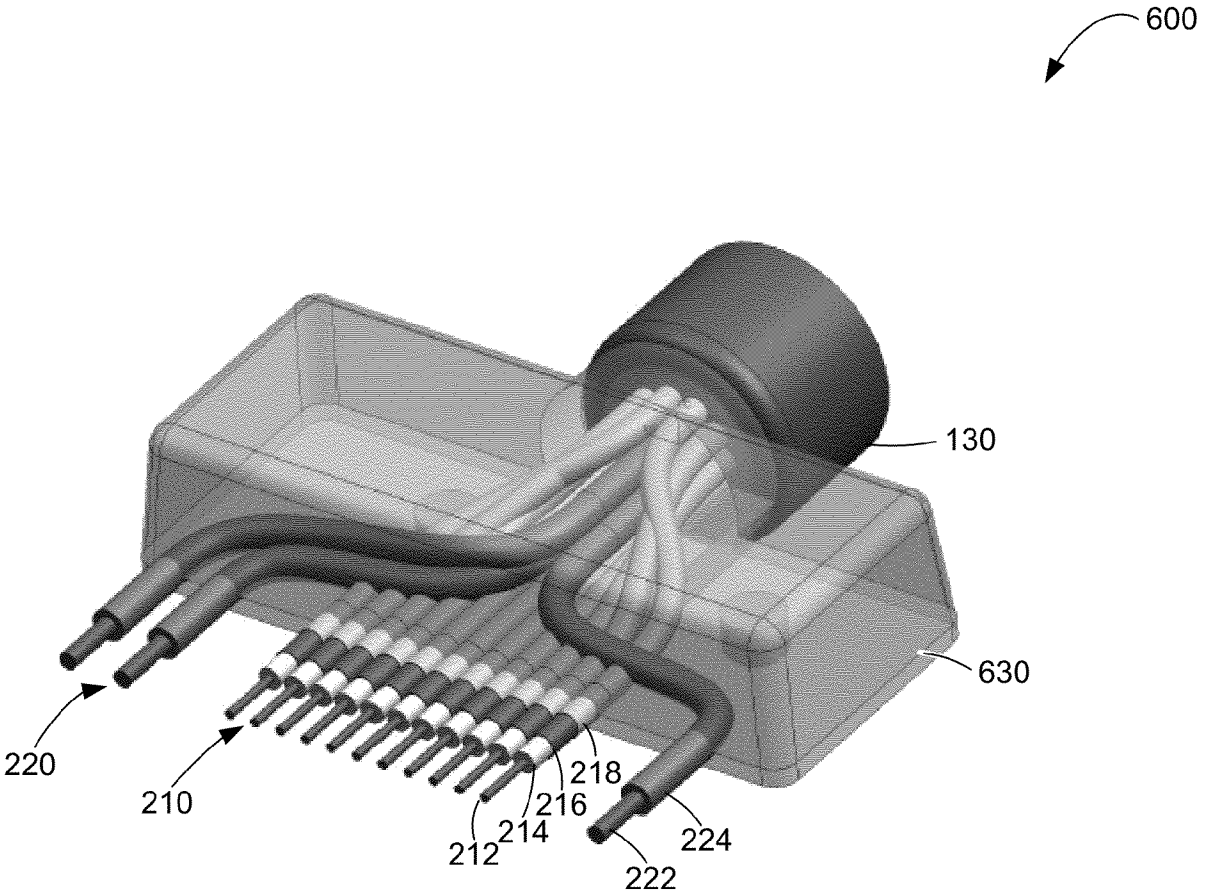
FIG. 6 illustrates a termination block according to an embodiment of the present invention.
Figure 7:
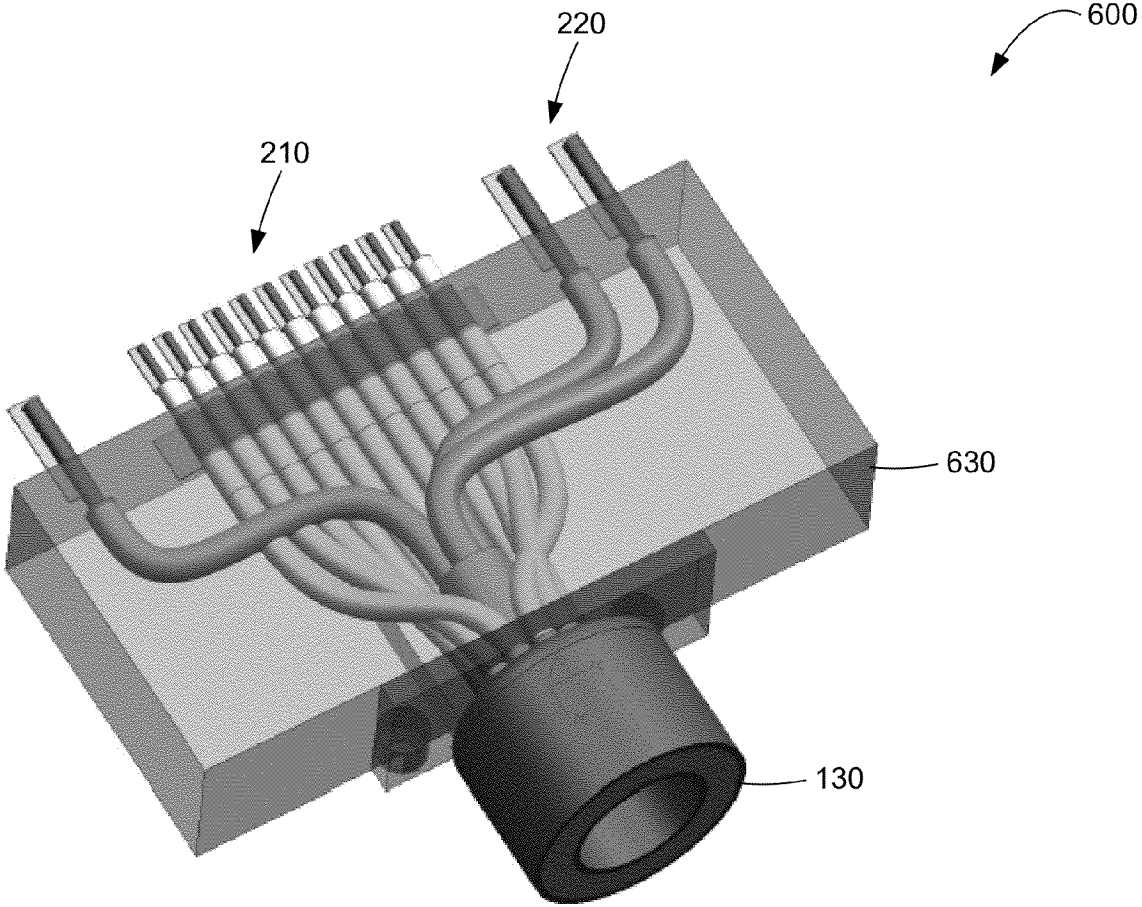
FIG. 7 illustrates a second view of the termination block of FIG. 6.

FIG. 6 illustrates a termination block according to an embodiment of the present invention. FIG. 7 illustrates a second view of the termination block of FIG. 6. In this example, a number of conductors 210 and 220 may be received by termination block 630 from cable 130. Termination block 630 may be formed around these conductors. Termination block 630 may provide conductors 210 and 220 at appropriate locations to make contact with a printed circuit board in a connector insert or connector receptacle.

In this specific example, a first number of power conductors 210 are arranged in a first row by termination block 630, while a second number of signal conductors 210 are arranged in a second row by termination block 630. Before contact is made to a printed circuit board, various layers of these conductors may be removed. For example, insulating layers 214 and 218 may be removed from conductors 210 to expose wires 212 and shield layers 216 such that they may be soldered to contacts on a printed circuit board. Specifically, wires 212 may be soldered to signal contacts on a printed circuit board, while braiding 216 may be soldered to a ground connection. Conductors 222 may similarly be exposed and soldered to contacts on a printed circuit board. The removal of these various insulating layers may be referred to as stripping or trimming.

Typically, these various conductors may be stripped or trimmed using lasers or other techniques. In this example, conductors 220, which may be used as power conductors, are located on each side of conductors 210, which ma be used as signal conductors. This arrangement allows lasers to move across the termination block and trim the power and signal conductors without interference from each other. This simplifies the manufacturing process.

Unfortunately, in some circumstances, space constraints limit the ability to place power conductors on each side of the signal conductors. In such a case, the power conductors may need to overlap the signal conductors in the vertical direction. In this case, one set of these conductors may need to be moved out of the way while trimming takes place. To make this easier, the termination block may be stepped. An example of such a stepped termination block is shown in the following figure.

Figure 8:
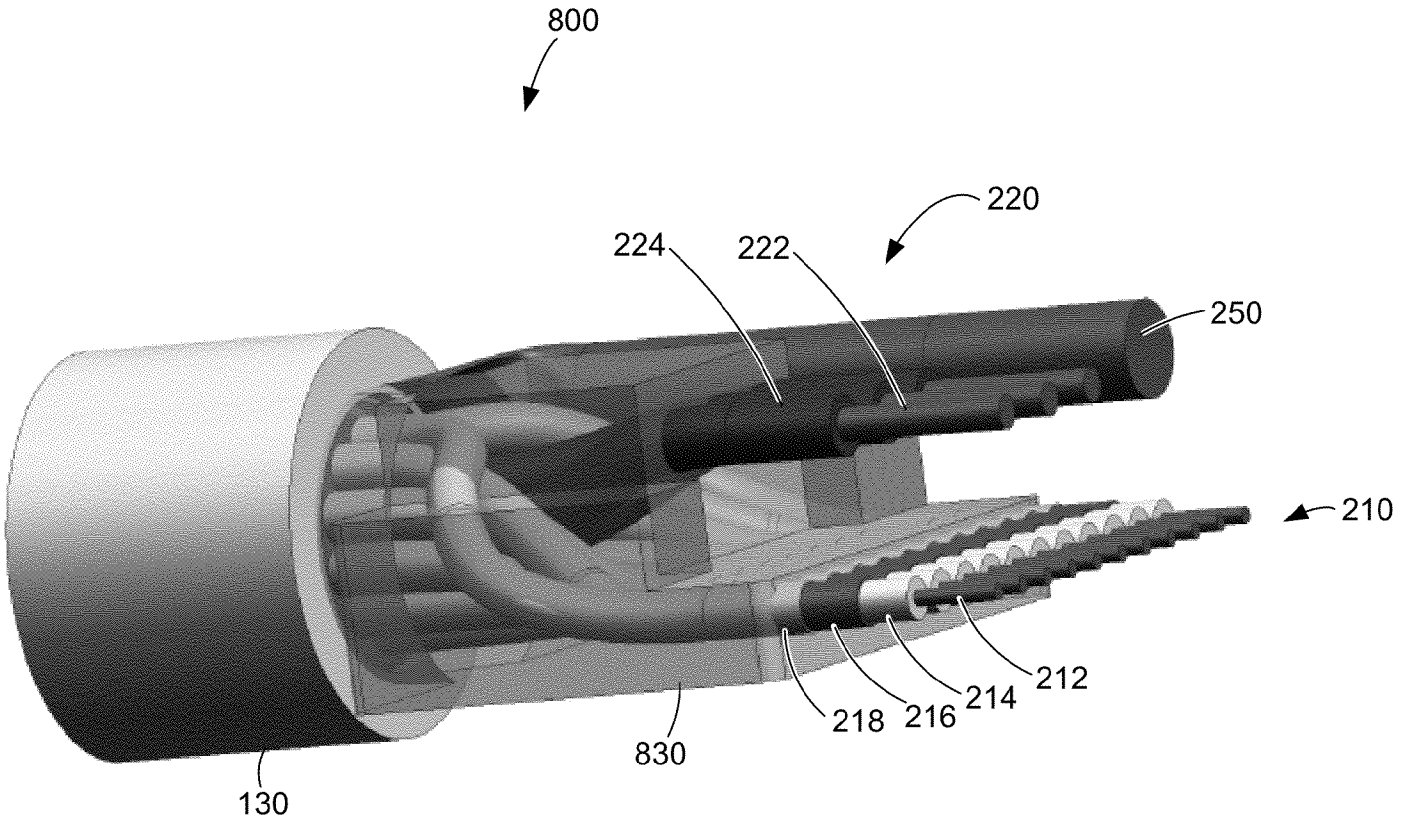
FIG. 8 illustrates a stepped termination block according to an embodiment of the present invention.

FIG. 8 illustrates a stepped termination block according to an embodiment of the present invention. In this example, stepped termination block 830 provides conductors 220, which may be power conductors, in a first row, and conductors 210, which may be signal conductors, in a second row. In this example, cable braiding or shield layer 250 may also be provided as part of the first row.

In this specific example, termination block 830 may be stepped such that power conductors 220 emerge from termination block 830 at a point behind the location where signal conductors 210 emerge from termination block 830. During assembly, power conductors 220 and shield 250 may be folded up out of the way while signal conductors 210 are trimmed. Following this trimming, power conductors 220 may be trimmed. In a specific embodiment of the present invention, signal conductors 210 are trimmed using a laser, while power conductors 220 are trimmed by hand. This allocation of labor between laser and hand trimming provides a benefit in that the more numerous and complicated trimming involved with signal conductors 210 are performed mechanically with a laser, while the fewer numbered and simpler power conductor stripping is done by hand. This also makes sense considering the desire typically to match signal conductors, a concern which is typically absent in regards to power conductors. That is, laser-trimmed conductors are more likely to match accurately than hand-trimmed conductors.

Again, once these connectors are stripped, they may be attached to contacts on a printed circuit board. An example is shown in the following figure.

Figure 9:
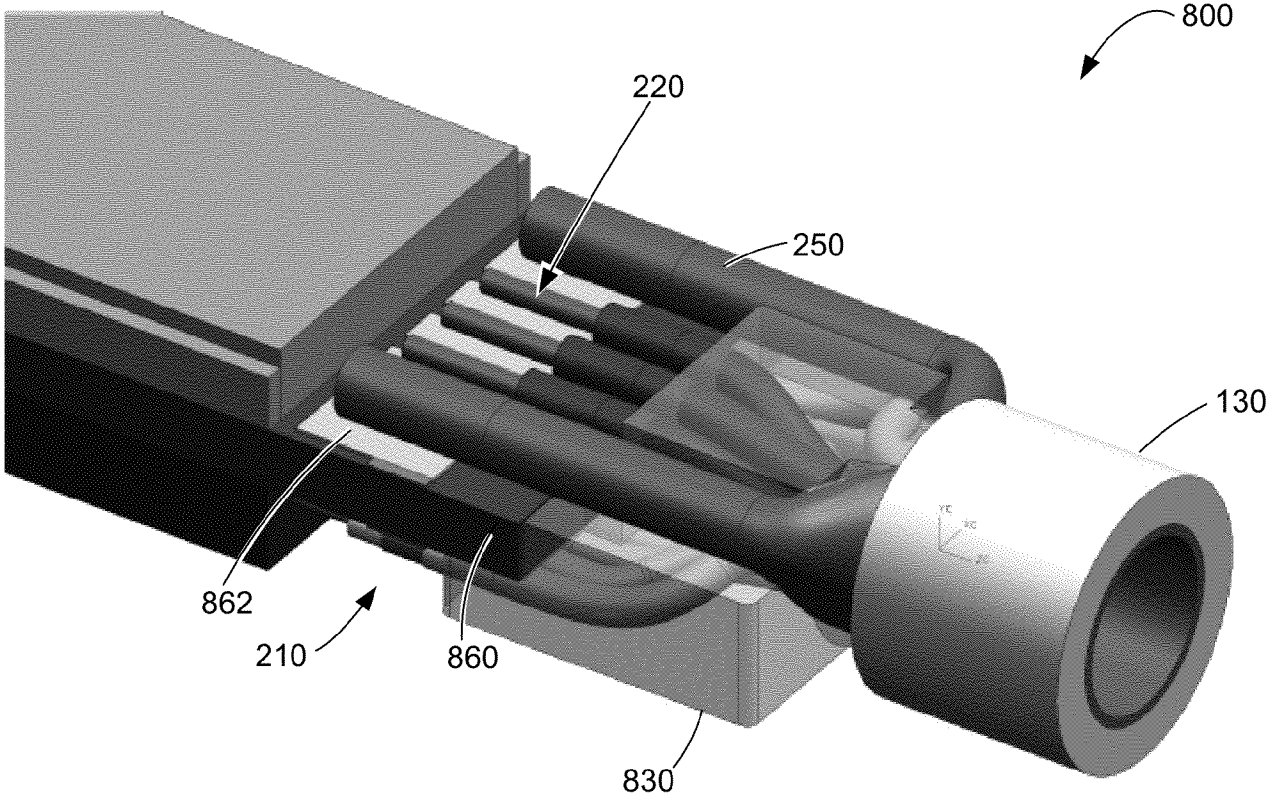
FIG. 9 illustrates a portion of a connector insert or connector receptacle according to an embodiment of the present invention.

FIG. 9 illustrates a portion of a connector insert or connector receptacle according to an embodiment of the present invention. In this example, conductors 210 and 220 emerge from termination block 830 and are connected to printed circuit board 860 at contacts 862.

Again, the stepped termination block allows the more numerous and complicated task of trimming signal conductors to be done with a laser, even though power conductors are potentially in the way and need to be folded back during trimming. This allows the power conductors to be placed in a row directly over the signal conductors thereby reducing the size of the resulting connector insert. An example of this method of manufacturing is shown in the following figure.

Figure 10:
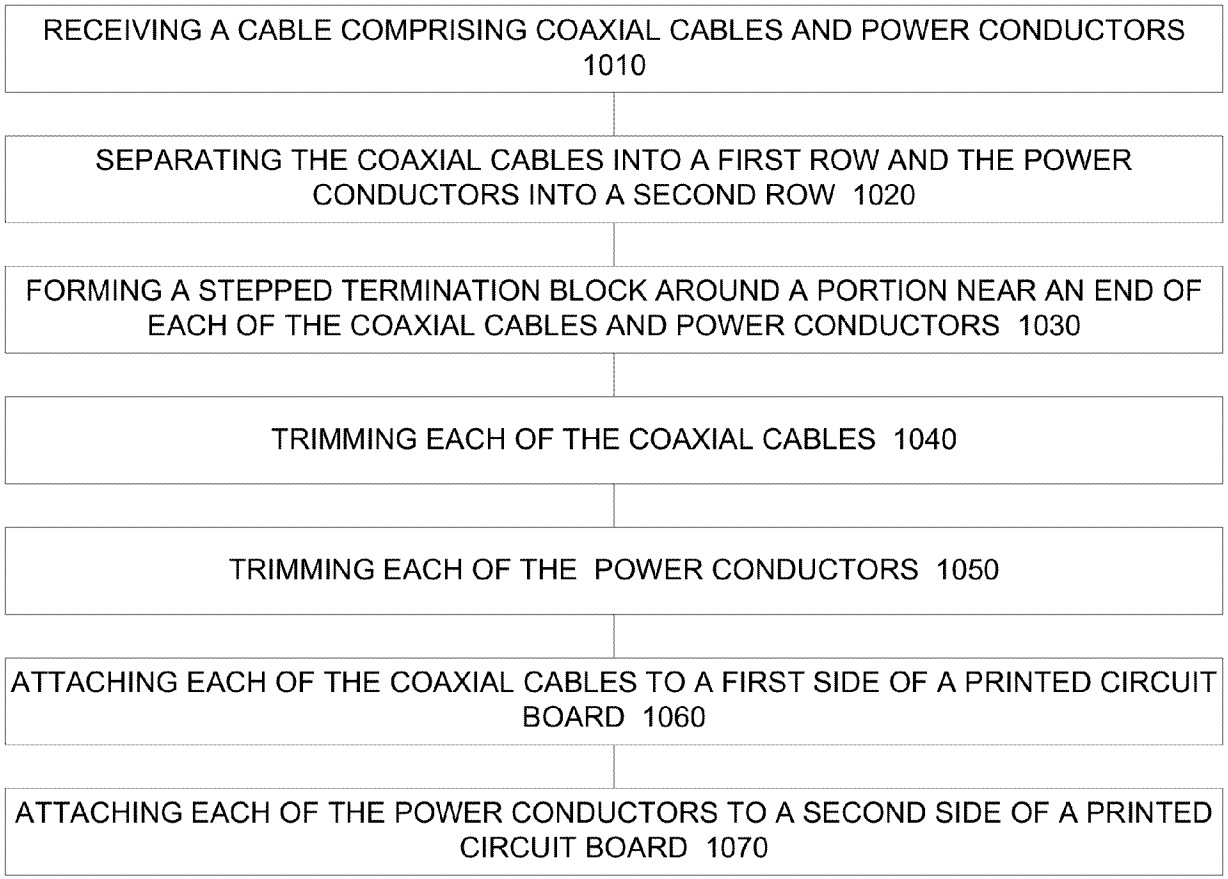
FIG. 10 illustrates a flowchart of a method of assembling a connector insert or receptacle according to an embodiment of the present invention.

FIG. 10 illustrates a flowchart of a method of assembling a connector insert or receptacle according to an embodiment of the present invention. In act 1010, a cable comprising a number of coaxial cables power conductors is received. In act 1020, the coaxial cables are separated in a first row and the power conductors are separated second row and a stepped termination block is formed around portion near an end of each of the coaxial cables and power conductors in act 1030. In act 1040, the coaxial cables may be trimmed. These cables may be trimmed by holding power conductors up out of the way. In act 1050, the power conductors may be trimmed. These power conductors may be trimmed by hand, or by laser or other means. In acts 1060 and 1070, the coaxial cables and power conductors may be attached to sides of a printed circuit board.

Again, the shielding or braiding 250 of cable 130 may be attached to pads on a printed circuit board. In various embodiments of the present invention, this braiding or shield layer may be used to improve the dissipation of heat generated by circuitry on printed circuit board. An example is shown in the following figure.

Figure 11:
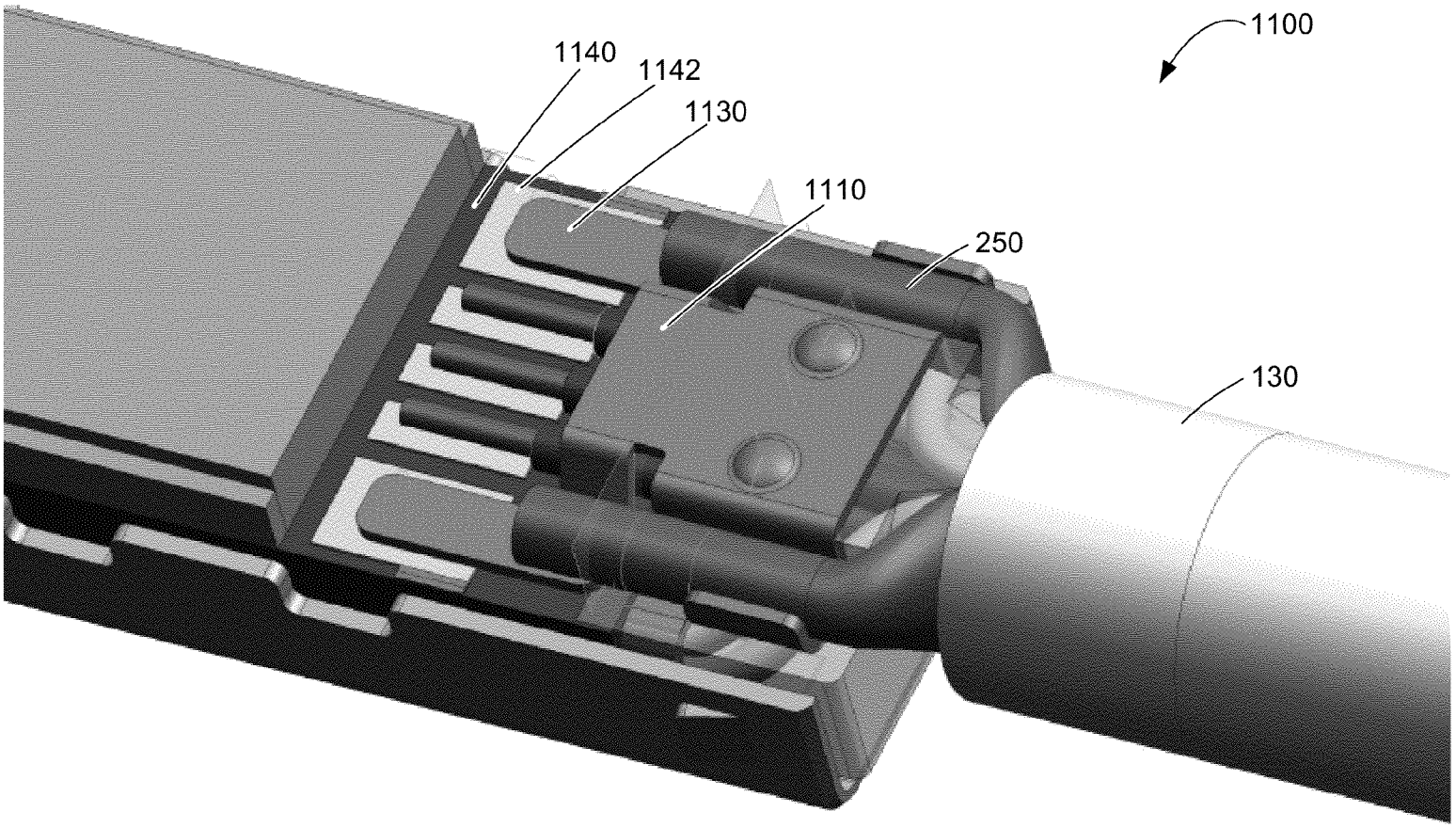
FIG. 11 illustrates a portion of a connector insert or receptacle according to an embodiment of the present invention.

FIG. 11 illustrates a portion of a connector insert or receptacle according to an embodiment of the present invention. In this example, shield layer 250 is crimped in two places by crimping piece 1110. Crimping piece 1110 may include prongs 1130. Prongs 1130 may be connected to contacts 1142 on printed circuit board 1140.

In this way, heat generated by circuitry on printed circuit board 1140 may flow through prongs 1130 into braiding 250, where it may be further dissipated in the cable 130. Also, heat may flow into crimping piece 1110 and into a shield or other housing (not shown) of the connector insert where it is dissipated.

In some embodiments of the present invention, a termination block may be formed of more than one piece. For example, a second piece may be included which may act as a guide for power conductors 220. In this way, the termination block may be stepped and the power conductors may be as mechanically stabilized by the second piece. An example is shown in the following figure.

Figure 12:
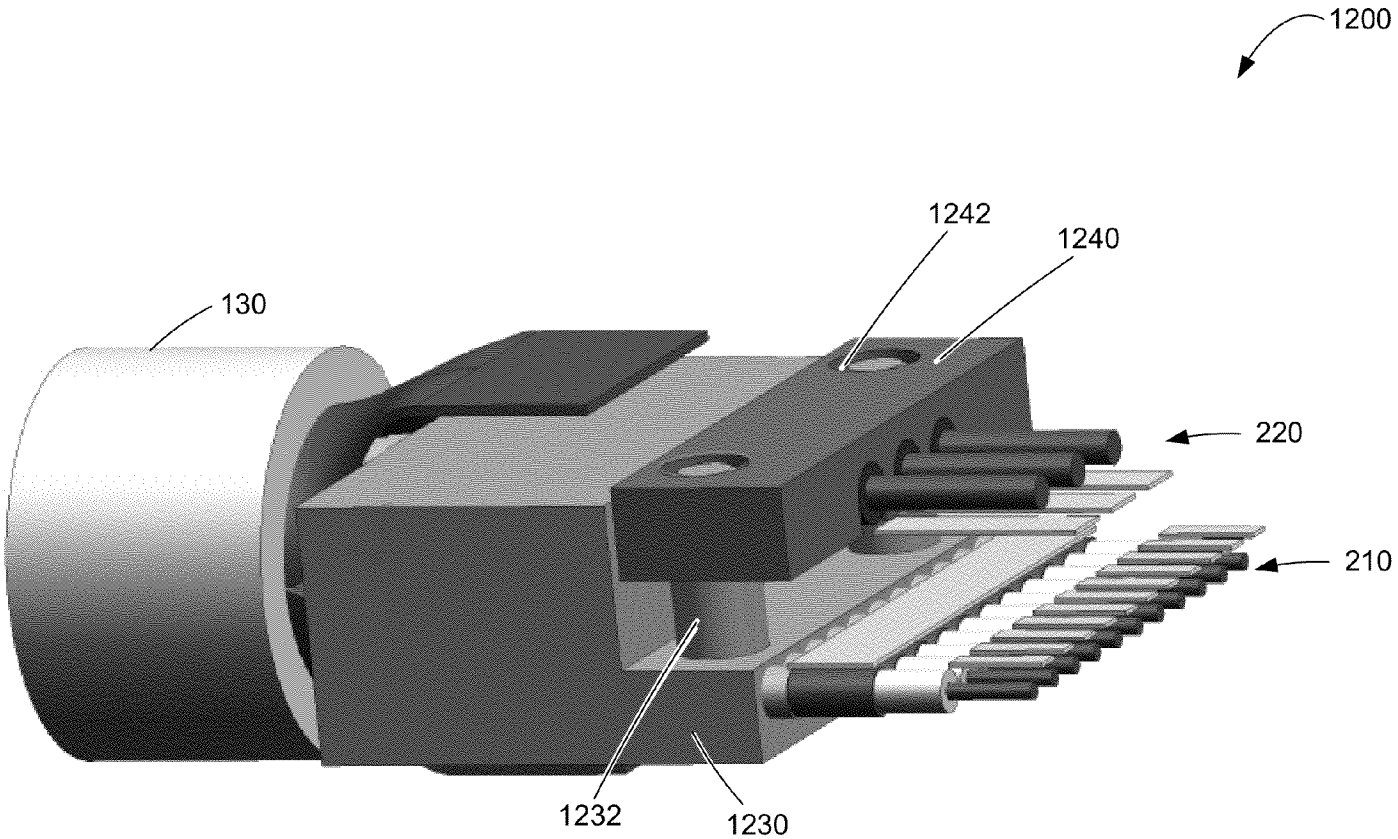
FIG. 12 illustrates a portion of a connector insert according to an embodiment of the present invention.

FIG. 12 illustrates a portion of a connector insert according to an embodiment of the present invention. In this figure, termination block 1230 provides signal conductors 210 in a first row, and power conductors 220 in a second row. A second termination piece 1240 may be used as a guide for power conductors 220. Second termination piece 1240 may aligned to termination block 1230 using posts 1232, which fit in openings 1242 of second termination piece 1240. This arrangement provides for secure mechanical arrangement for power conductors 1220 while also allowing the removal of second termination piece 1240 such that power conductors 1220 can be folded back of the way during trimming of signal conductors 1210. That is, without second termination piece 1240, power conductors 220 have a reduced mechanical stability as compared to signal conductors 210 since they emerge from termination block 1230 ahead of signal conductors 210. With second termination piece 1240, power conductors 220 emerge from termination block 1230 at a similar point as signal conductors 210.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A cable assembly comprising:

a cable comprising:

a plurality of coaxial conductors; and a plurality of power conductors; and a connector insert comprising:

a termination block around a portion of each of the plurality of coaxial conductors and each of the plurality of power conductors, the coaxial conductors aligned in a first row in the termination block, the power conductors aligned in a second row in the termination block; and a printed circuit board having a first plurality of contacts on a first side coupled to the plurality of coaxial conductors, each of the coaxial conductors in the cable coupled to one of the first plurality of contacts, and a second plurality of contacts on a second side coupled to the plurality of power conductors, each of the power conductors in the cable coupled to one of the second plurality of contacts.

2. The cable assembly of claim 1 wherein the termination block is stepped such that the termination block is around each of the plurality of coaxial conductors for a longer length than the termination block is around each of the plurality of power conductors.

3. The cable assembly of claim 1 wherein the cable further comprises a shield layer, and the shield layer couples to a first contact on the second side of the printed circuit board.

4. The cable assembly of claim 1 wherein the cable assembly further comprises a crimping piece, and the cable further comprises a shield layer, the crimping piece crimped at least partially around the shield layer, the crimping piece coupled to a first contact on the second side of the printed circuit board.

5. The cable assembly of claim 1 wherein the plurality of coaxial conductors each comprise:

a plurality of central conductors;

an insulating layer around the plurality of central conductors;

a shield around the insulating layer.

6. The cable assembly of claim 5 wherein the shield comprises a rotating spiral.

7. The cable assembly of claim 5 wherein the shield comprises a plurality of rotating spirals.

8. The cable assembly of claim 1 wherein each of the power conductors comprises a plurality of central conductors surrounded by an insulating layer.

9. The cable assembly of claim 1 wherein the termination block is formed from injection-molded plastic.

10. A connector insert comprising:

a termination block having a first row of passages, each passage in the first row to accept one of a plurality of coaxial cables, and a second row of passages, each passage in the second row to accept one of a plurality of power conductors; and a printed circuit board having a first plurality of contacts on a first side, each to couple to one of the plurality of coaxial cables, and second plurality of contacts on a second side, each to couple to one of the plurality of power conductors.

11. The connector insert of claim 10 wherein the termination block is stepped such that passages in the first row of passages are longer than passages in the second row of passages.

12. The connector insert of claim 10 wherein a shield layer couples to a first contact on the second side of the printed circuit board.

13. The connector insert of claim 10 wherein the connector insert further comprises a crimping piece to be crimped at least partially around a shield layer, the crimping piece to couple to a first contact on the second side of the printed circuit board.

14. The connector insert of claim 10 wherein the termination block is formed from injection-molded plastic.

15. A method of forming a cable assembly comprising:

receiving a cable comprising a plurality of coaxial cables, a plurality of power conductors, and a first shield, the first shield surround the plurality of coaxial cables and the plurality of power conductors;

separating each of the plurality of coaxial cables in the cable into a first row;

separating each of the plurality of power conductors in the cable into a second row; and forming a termination block around a portion near an end of each of the plurality of coaxial cables in the first row and each of the plurality of power conductors in the second row, wherein the termination block is stepped such that the termination block is around a longer portion of each of the power conductors than the coaxial cables.

16. The method of claim 15 further comprising:

removing a first insulative layer from a portion of each of the coaxial cables to expose a length of a second shield layer;

removing the second shield layer from a portion of each of the coaxial cables to expose a length of second insulative layer; and removing the second insulative layer from a portion of each of the coaxial cables to expose a length of center conductors of each coaxial conductor.

17. The method of claim 16 further comprising:

removing an insulative layer from a portion of each of the power conductors to expose a length of center conductors of each power conductor.

18. The method of claim 17 further comprising:

attaching a printed circuit board to the plurality of coaxial cables and the plurality of power conductors such that the second shield layer of each of the coaxial cables is coupled to a first contact on a first side of the printed circuit board, the center conductors of each of the coaxial cables is coupled to one of a first plurality of contacts on the first side of the printed circuit board, and the center conductors of each of the power conductors is coupled to one of a second plurality of contacts on a second side of the printed circuit board.

19. The method of claim 18 further comprising:

attaching the first shield layer to a first pad on the second side of the printed circuit board.

20. The method of claim 18 further comprising:

crimping at least a portion of the first shield layer with a crimping piece and coupling the crimping piece to a first pad on the second side of the printed circuit board.

21. A cable assembly comprising:

a cable comprising:

a plurality of coaxial conductors;

a plurality of power conductors; and a shield around the plurality of coaxial conductors and the plurality of power conductors; and a connector insert comprising:

a termination block around a portion of each of the plurality of coaxial conductors and each of the plurality of power conductors, the coaxial conductors aligned in a first row in the termination block, the power conductors aligned in a second row in the termination block; and a printed circuit board having a first row of contacts on a first side coupled to the plurality of coaxial conductors and a second row of contacts on a second side coupled to the plurality of power conductors and the shield, wherein each of the contacts in the first row of contacts couples to a coaxial conductor in the plurality of coaxial conductors and each of the contacts in the second row of contacts couple to a power conductor in the plurality of power conductors or the shield.

22. The cable assembly of claim 21 wherein the termination block is stepped such that the termination block is around each of the plurality of coaxial conductors for a longer length than the termination block is around each of the plurality of power conductors.

23. The cable assembly of claim 21 wherein the termination block is formed from injection-molded plastic.

* * * * *